United States Patent [19]

Booth et al.

[11] Patent Number: 4,474,503

[45] Date of Patent: Oct. 2, 1984

[54] TRAFFIC CONTROL APPARATUS

[76] Inventors: William L. Booth; Leslie S. Stone, both of Industrial Center Bldg., Sausalito, Calif. 94965

[21] Appl. No.: 360,584

[22] Filed: Mar. 22, 1982

[51] Int. Cl.[3] ..... E01F 13/00; E01F 15/00

[52] U.S. Cl. ..... 404/6; 404/9; 116/63 R

[58] Field of Search ..... 404/6, 9, 12, 13, 14, 404/83, 71; 116/63 R; 104/4

[56] References Cited

U.S. PATENT DOCUMENTS

| | | | |
|---|---|---|---|
| 2,182,697 | 12/1939 | Jelinek | 404/6 |
| 2,287,685 | 6/1942 | Jelinek | 404/12 |
| 2,931,279 | 4/1960 | Wiswell | 404/13 |
| 3,349,674 | 10/1967 | Hutwelker | 404/12 X |
| 3,958,890 | 5/1976 | Ferrari | 404/9 |
| 4,017,200 | 4/1977 | Woods, Jr. | 404/6 |
| 4,307,973 | 12/1981 | Glaesener | 404/6 |

*Primary Examiner*—James A. Leppink
*Assistant Examiner*—Beverly E. Hjorth
*Attorney, Agent, or Firm*—Joseph L. Strabala

[57] ABSTRACT

Traffic control apparatus employs an elongated barrier separating adjacent lanes of a highway. The barrier consists of a series of barrier sections hingedly secured together. A self propelled vehicle engages the barrier sections seriatim, elevates them and guides them within the vehicle along a generally sinusoidal path from one lane divider to another and discharges them.

4 Claims, 10 Drawing Figures

Fig. 1.
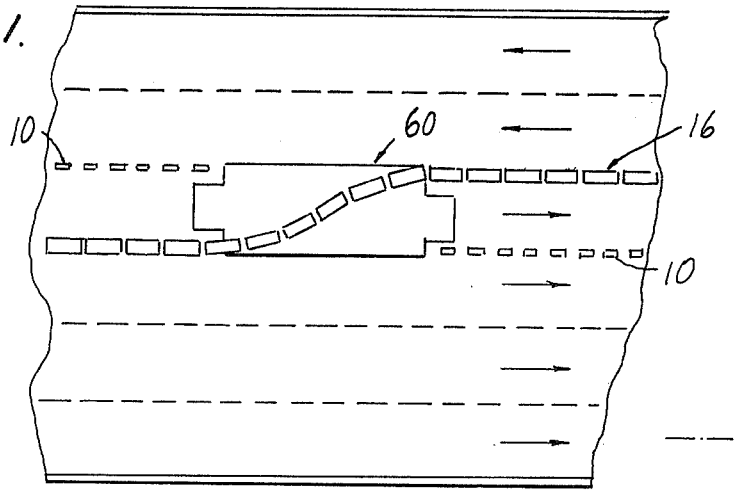
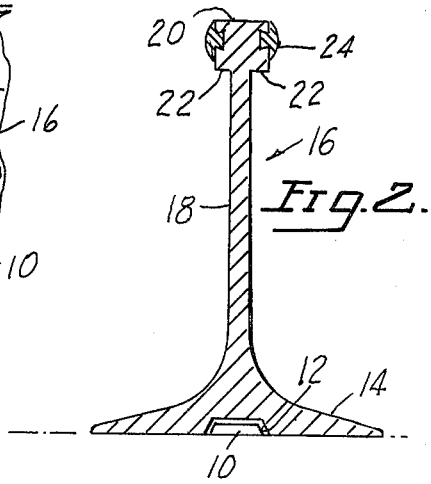
Fig. 2.
Fig. 3.
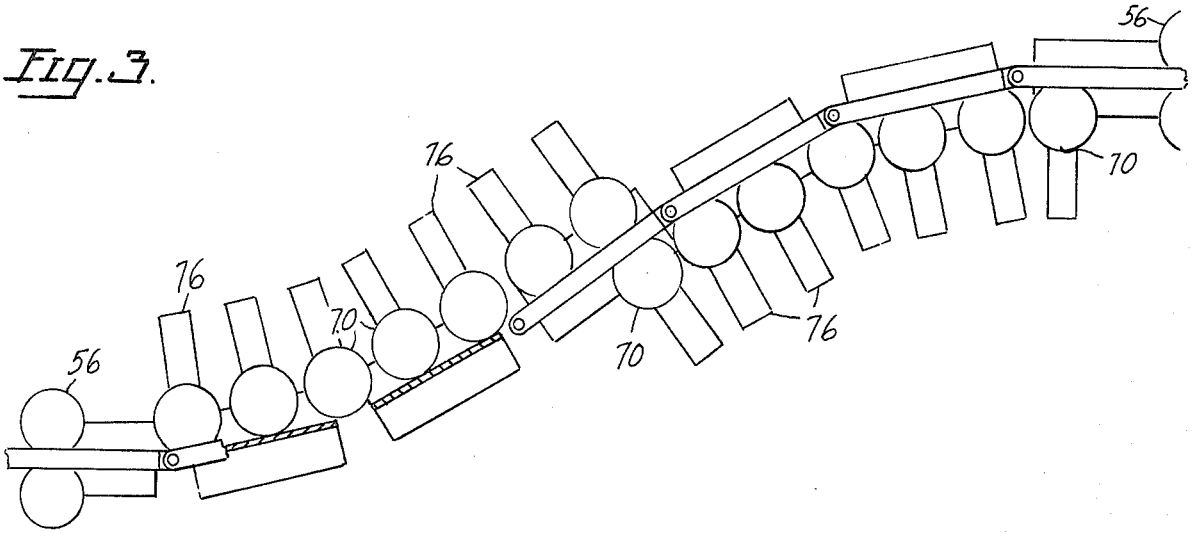
Fig. 4.
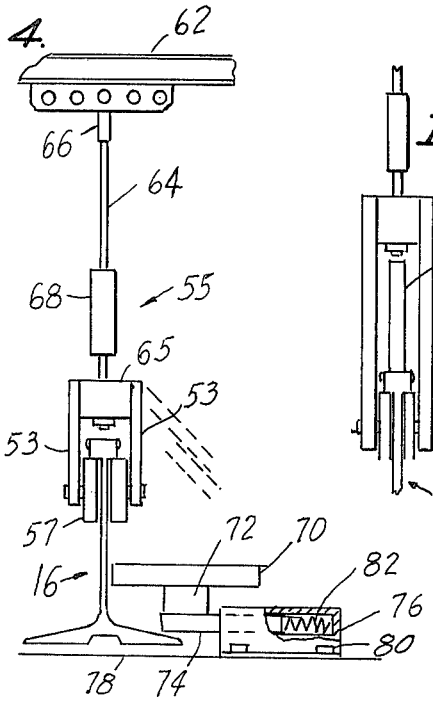
Fig. 6
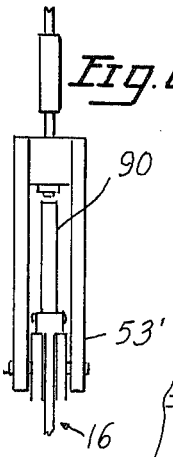
Fig. 5.
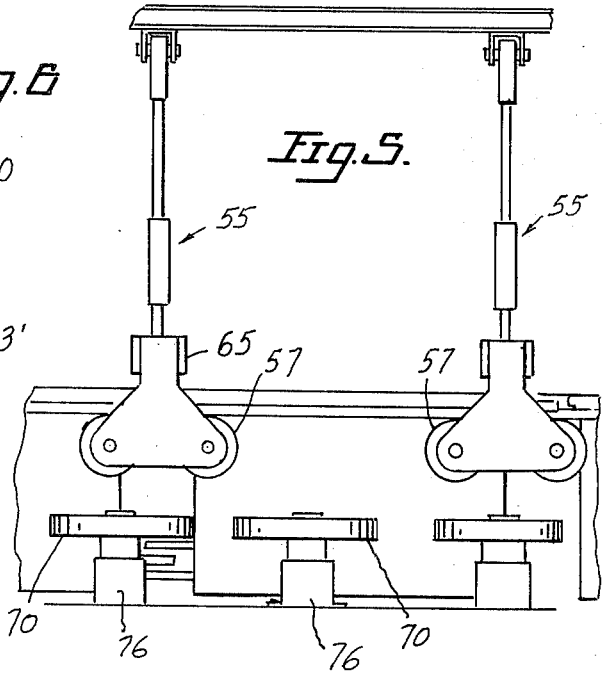

Fig. 7.
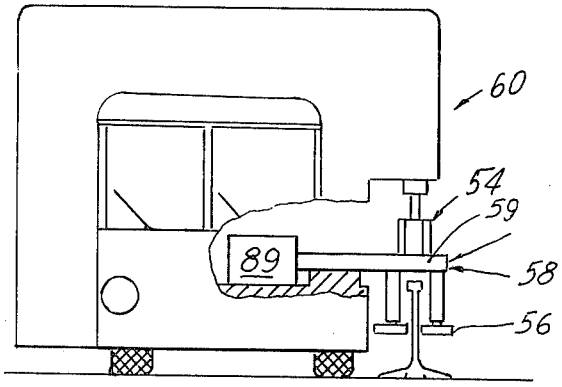
Fig. 8.
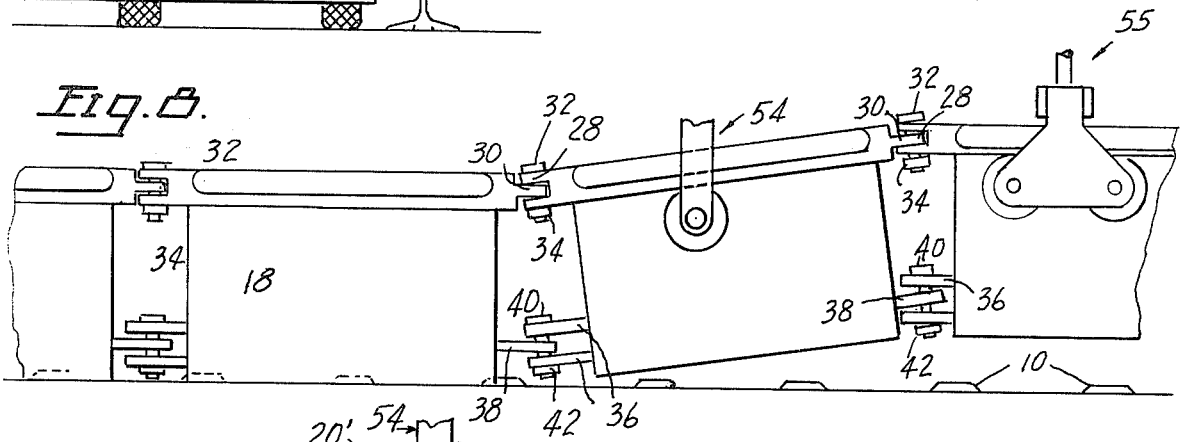
Fig. 9.
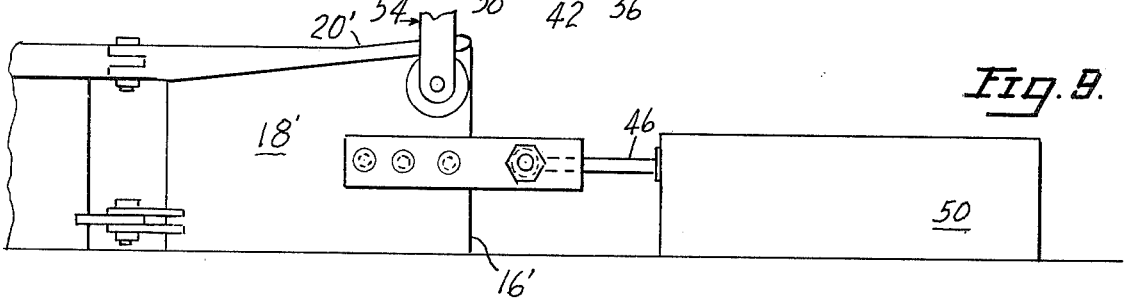
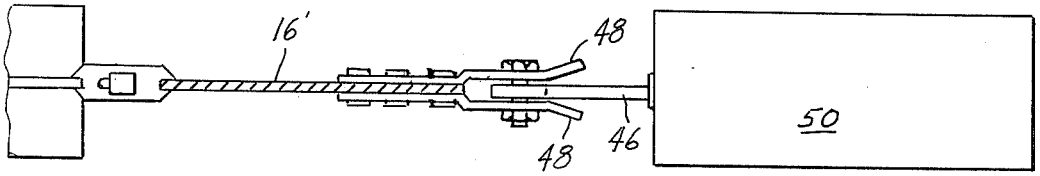
Fig. 10.

TRAFFIC CONTROL APPARATUS

This invention relates to traffic control apparatus for changing the number of traffic lanes in both directions of traffic flow. As is well known, it is desirable to be able to increase the number of traffic lanes to suit the amount of traffic so that at peak commuting hours there are more lanes provided for the heavy traffic and less lanes for the lighter traffic.

This problem has been recognized in the past and different types of proposals have been made. See for example U.S. Pat. Nos. 2,931,279; 3,391,620; 3,958,890; 4,004,857; and 4,107,200.

Ideally it is desirable to provide a barrier that is high enough and strong enough to prevent head-on collisions. This feature is not incorporated in most of the above noted patents. Furthermore an effective, economical and practical method for automatically moving the barrier from one lane divider to an adjacent lane divider has not been provided in the above noted prior art.

The main objects of the present invention are the provision of an effective traffic barrier for physically separating lanes of oppositely directed traffic and the provision of apparatus for moving the barrier from one lane divider to an adjacent lane divider.

Another object of the invention is the provision of traffic control apparatus which is relatively simple and which can effect a rapid change-over of lanes when desired.

Other objects and advantages will be apparent from the following specification and drawings.

FIG. 1 is a schematic reduced scale plan view of a portion of a highway showing the apparatus of the present invention in use.

FIG. 2 is a large scale typical cross section of the traffic barrier.

FIG. 3 is a horizontal section through a portion of the vehicle showing the guide means with the trolleys omitted for clarity.

FIG. 4 is an end elevation of one of the trolleys.

FIG. 5 is a side elevation of a portion of the conveyor system.

FIG. 6 is a modified form of the trolley of FIG. 4 incorporating a glare screen.

FIG. 7 is a front elevation of the vehicle.

FIG. 8 is a side elevation of the barrier at the point engaged by the vehicle and the coneyor system.

FIG. 9 is a side elevation of one end of the barrier.

FIG. 10 is a horizontal section of the structure of FIG. 9.

Referring first to FIG. 1 the adjacent lanes of the highway involved are provided with a series of spaced apart upwardly projecting lugs 10 constituting the lane dividers for said lanes. As best seen in FIG. 2 each lug is generally rectangular with slanted sides to be loosely received within a complementarily formed downwardly opening slot 12 on the base 14 of each barrier section generally designated 16 in FIG. 2.

The relatively wide barrier base 14 provides a means for preventing a vehicle from striking the barrier since the rumble caused by the wheels of a vehicle converging on the spaces between the barrier sections will alert the driver that he is too close. Furthermore overturning of the barrier is substantially obviated when the weight of a vehicle wheel is on the base.

Typical barrier sections are shown in FIG. 8 and it will be seen from FIG. 2 that a relatively thin central web portion 18 extends upwardly from base 14 and the upper end of the section is provided with a continuous flange or top 20 which is formed with a pair of downwardly facing flat shoulders 22 on each side for a purpose to be described. If desired, a resilient rubbing strip 24 may be imbedded in each side of the top. It will be seen from FIG. 2 that the lugs 10 and slots 12 provide an effective structure for properly positioning the barrier sections in their desired predetermined positions on the lane dividers.

Referring to FIG. 8 each barrier section 16 is swingably secured to the adjacent section at the top by lugs 28 on one section and lug 30 on the other with a bolt 32 and nut 34 acting as a pivot. The bolt holes in said lugs are elongated to permit one section to be tilted with respect to the adjacent one as seen in FIG. 8.

Similarly, the lower portions of the sections 16 are swingably connected by lugs 36,38, bolts 40 and nuts 42. In the case of the lower pivot the lugs and bolt holes must be longer to permit the tilting as shown in FIG. 8.

At each end of the barrier a special section 16′ is provided as seen in FIGS. 9,10. Secured to each section 16′ are jaw plates 48 between which is secured an eye bolt 46 which in turn is fastened to a relatively heavy anchor 50. Adjustable means (not shown) can be provided inside anchor 50 to permit adjustment of the effective length of the barrier.

The terminal barrier section 16′ is modified by flaring the top flange 20′ upwardly as seen in FIG. 9 so that a trolley generally designated 54 may engage the same.

A typical trolley is seen in FIG. 4 and the same includes a pair of cheek plates 53 to which are rotatably secured rollers 57 which engage the downwardly facing surfaces 22 of the barrier section.

The vehicle, generally designated 60 in FIGS. 1 and 7, may be self propelled in any desired manner and is preferably provided with a power supply and the usual auxiliary equipment at each end. Adjacent the driver's cab is the trolley 54 which is adapted to engage the end barrier section 16′ as indicated in FIG. 9 and then engage each succeeding section as the vehicle proceeds along its predetermined path. Trolley 54 is substantially identical to that shown in FIGS. 4,5 except that only one pair of opposed rollers are used.

Also adjacent the cab of the vehicle are a pair of spaced apart horizontally disposed rollers 56 (FIG. 7) which are rotatably supported on a bracket structure 58 fixed to the vehicle. These rollers 56 are spaced apart a distance slightly greater than the thickness of web 18 of the sections 16 so that each section is adequately held against lateral shifting. Bracket structure 58 includes a horizontally extending arm 59 which may be connected to a hydraulic cylinder 89 (FIG. 7) to permit lateral shifting of roller 56 relative to the vehicle when necessary.

Within the vehicle 60 trolleys 55 are supported from the roof 62 (FIGS. 4,5) and include a rod 64 suspended by eye bolt 66 from said roof and a swivel 65. A turnbuckle 68 is associated with rod 64 to permit careful adjustment of the elevation of the barrier sections.

The trolleys 55 are spaced apart along the desired sinusoidal path of travel of the barrier sections and the sections are further guided by horizontally disposed guide rollers 70. As best seen in FIGS. 4,5 each roller 70 is rotatably supported in a bearing 72 which in turn is secured to a bar 74 slidably supported in a base 76. Said base 76 is secured to the floor 78 of the vehicle by bolts 80 which permit careful adjustment of each base so that the associated barrier section follows the predetermined sinusoidal curve shown in FIG. 3.

In order to permit the required slight lateral movement of rollers 70 each bar 74 is spring urged against the section by a compression spring 82 housed within base 76.

The structure at the discharge end of the vehicle is the same as that of the forward end and permits the sections to be lowered onto the lugs 10 of the lane on which the barrier is to be supported. It will be apparent that the above described structure is adjustable for lanes of different widths.

It will also be apparent that the above described barrier has the weight, stability, strength and continuity to resist forces caused by a vehicle colliding with the same. In the event that a portion of the barrier is damaged the damaged sections may be repaired or replaced in the vehicle. In this connection one of the cheek plates 56 may be swingably secured to the trolley as seen in FIG. 4 to permit ready removal of a section.

It will be apparent that the step of placing the barrier sections along the lane dividers will cause the barrier to be under longitudinal tension. This is desirable as it enhances the barrier's ability to resist the force of collisions.

If desired the trolleys 55 may be modified to accommodate headlight glare screens. For example in FIG. 6 the cheek plates of the trolleys may be elongated as indicated at 53' to clear the glare screen 90.

It will be apparent that the conveyor system disclosed herein may take different forms. For example, instead of suspended trolleys a structure may be built up from the floor of the vehicle to support the moving barrier sections.

I claim:

1. A segmented traffic control barrier capable of providing a safe separation between continuous lanes of opposing vehicle traffic that are adapted to be easily moved across lanes for reversible traffic lanes comprising:

a continuous barrier having a plurality of connected barrier sections, each of said sections having a flat base member and a vertical web member fixedly secured to said base member to form an inverted T-like structure, hinge means connecting said barrier sections in a continuous string to form said barrier, said hinge means including a first hinge means located adjacent to the top of said vertical web at each end of each section and a second hinge means located adjacent to the bottom of said vertical web at each end of each section, said first hinge means allowing articulation between the connected sections without internal movement in said hinge means and said second hinge means operable to allow the base portions of adjacent section to move together and apart while maintaining vertical registry between adjacent sections, said hinge means allowing articulation in said barrier when the barrier is relocated from one lane to another through a sinusoidal transposition path.

2. The segmented traffic control barrier defined in claim 1 wherein the underside of the base member includes a longitudinal groove along its axial length whereby the barrier may be placed over lane markers for alignment.

3. The segmented traffic control barrier defined in claim 1 including separate anchor means connected to its opposite ends, said anchor means operable to prevent relative movement of said barrier relative to said anchor means and at least one tensioning means in said anchor means operable to place increased tension on said barrier.

4. The segmented traffic control barrier as defined in claim 1 wherein the top of the vertical web member includes a horizontal flange by which the barrier may be supported on dolly means when it is being transposed from lane to lane along a sinusoidal transposition path.

* * * * *